US007556032B2

(12) United States Patent
Jones et al.

(10) Patent No.: US 7,556,032 B2
(45) Date of Patent: Jul. 7, 2009

(54) PNEUMATIC PAINTBALL GUN

(75) Inventors: Danial Jones, Waterford, MI (US); William Gardner, Jr., Latrobe, PA (US)

(73) Assignee: Smart Parts, Inc., Loyalhanna, PA (US)

( * ) Notice: Subject to any disclaimer, the term of this patent is extended or adjusted under 35 U.S.C. 154(b) by 404 days.

(21) Appl. No.: 11/056,938

(22) Filed: Feb. 11, 2005

(65) Prior Publication Data

US 2006/0011186 A1 Jan. 19, 2006

Related U.S. Application Data

(63) Continuation-in-part of application No. 10/869,829, filed on Jun. 15, 2004.

(51) Int. Cl.
*F41B 11/00* (2006.01)

(52) U.S. Cl. ..... 124/73

(58) Field of Classification Search ..... 124/71–77
See application file for complete search history.

(56) References Cited

U.S. PATENT DOCUMENTS

| | | | | |
|---|---|---|---|---|
| 2,304,320 A | | 12/1942 | Tratsch | 124/77 |
| 2,327,653 A | * | 8/1943 | Lisle | 124/57 |
| 2,554,116 A | | 5/1951 | Monner | 124/11 |
| 2,568,432 A | | 9/1951 | Cook | 124/77 |
| 2,594,240 A | | 4/1952 | Wells | 124/13 |
| 2,634,717 A | | 4/1953 | Junkin | 124/11 |
| 2,834,332 A | | 5/1958 | Guthrie | 124/77 |
| 2,845,055 A | | 7/1958 | Collins et al. | 124/32 |

(Continued)

FOREIGN PATENT DOCUMENTS

DE 4237360 C1 * 6/1994

(Continued)

OTHER PUBLICATIONS

Matrix-Main Body Assembly & Parts Listing at http://www.directpaintball.com/pics/diablomatrix/matrixparts.gif. 3 pages.

(Continued)

*Primary Examiner*—Troy Chambers
(74) *Attorney, Agent, or Firm*—Simple IP Law, P.C.; Craig Rogers

(57) ABSTRACT

A pneumatic assembly preferably includes a sealing member disposed between a compressed gas storage area and a compressed gas releasing area. A piston rod is preferably arranged in communication with the sealing member and disposed longitudinally in the pneumatic assembly extending between the compressed gas storage and compressed gas releasing areas. One or more vent channels are preferably formed in the piston rod, with one or more ribs arranged longitudinally through or between the vent channels. The ribs are preferably configured to maintain the sealing member within a sealing member retaining groove while compressed gas is being released from the compressed gas storage area to the compressed gas releasing area. A grip mounted circuit board arrangement can also be provided wherein a circuit board is configured to securely mount within one or more slots arranged in a grip frame of a paintball gun. The circuit board may include a solenoid valve and a trigger-actuated switch arranged on the circuit board. The paintball gun can further include an interchangeable external shell for housing the pneumatic assembly.

29 Claims, 16 Drawing Sheets

U.S. PATENT DOCUMENTS

| | | | | | |
|---|---|---|---|---|---|
| 2,845,805 | A | | 7/1958 | Collins et al. | 124/77 |
| 2,945,487 | A | * | 7/1960 | Webby | 124/69 |
| 3,089,476 | A | | 5/1963 | Wolverton | 124/77 |
| 3,192,915 | A | | 7/1965 | Norris et al. | 124/77 |
| 3,465,742 | A | * | 9/1969 | Herr | 124/77 |
| 3,662,729 | A | | 5/1972 | Henderson | 124/73 |
| 3,695,246 | A | | 10/1972 | Filippi et al. | 124/77 |
| 3,794,289 | A | * | 2/1974 | Taylor | 251/149.7 |
| 3,915,143 | A | | 10/1975 | Waller | 124/11 R |
| 3,921,980 | A | | 11/1975 | Artzer | 124/77 |
| 4,009,536 | A | | 3/1977 | Wolff | 42/84 |
| 4,094,294 | A | | 6/1978 | Speer | 124/56 |
| 4,269,163 | A | | 5/1981 | Feith | 124/77 |
| 4,362,145 | A | | 12/1982 | Stelcher | 124/32 |
| 4,554,932 | A | * | 11/1985 | Conrad et al. | 131/296 |
| 4,730,407 | A | | 3/1988 | DeCarlo | 42/84 |
| 4,770,153 | A | | 9/1988 | Edelman | 124/77 |
| 4,819,609 | A | | 4/1989 | Tippmann | 124/72 |
| 4,899,717 | A | | 2/1990 | Rutten et al. | 124/32 |
| 4,936,282 | A | * | 6/1990 | Dobbins et al. | 124/74 |
| 5,063,905 | A | | 11/1991 | Farrell | 124/72 |
| 5,083,392 | A | | 1/1992 | Bookstaber | 42/84 |
| 5,228,427 | A | | 7/1993 | Gardner, Jr. | 124/71 |
| 5,261,384 | A | | 11/1993 | Hu | 124/66 |
| 5,280,778 | A | | 1/1994 | Kotsiopoulos | 124/73 |
| 5,285,765 | A | | 2/1994 | Lee | 124/50 |
| 5,333,594 | A | * | 8/1994 | Robinson | 124/73 |
| 5,337,726 | A | * | 8/1994 | Wood | 124/61 |
| 5,349,938 | A | | 9/1994 | Farrell | 124/73 |
| 5,383,442 | A | | 1/1995 | Tippmann | 124/76 |
| 5,413,083 | A | | 5/1995 | Jones | 124/32 |
| 5,462,042 | A | | 10/1995 | Greenwell | 124/76 |
| RE35,079 | E | * | 11/1995 | Sverdlin | 123/467 |
| 5,515,838 | A | | 5/1996 | Anderson | 124/76 |
| 5,613,483 | A | * | 3/1997 | Lukas et al. | 124/73 |
| 5,769,066 | A | * | 6/1998 | Schneider | 124/75 |
| 5,778,868 | A | * | 7/1998 | Shepherd | 124/76 |
| 5,878,736 | A | | 3/1999 | Lotuaco, III | 124/71 |
| 5,881,707 | A | * | 3/1999 | Gardner, Jr. | 124/77 |
| 5,967,133 | A | | 10/1999 | Gardner, Jr. | 124/77 |
| 6,003,504 | A | | 12/1999 | Rice et al. | 124/73 |
| 6,035,843 | A | | 3/2000 | Smith et al. | 124/77 |
| 6,142,136 | A | | 11/2000 | Velasco | |
| 6,343,599 | B1 | | 2/2002 | Perrone | 124/33 |
| 6,349,711 | B1 | * | 2/2002 | Perry et al. | 124/73 |
| 6,382,592 | B1 | * | 5/2002 | Kim | 251/355 |
| 6,439,217 | B1 | * | 8/2002 | Shih | 124/77 |
| 6,474,326 | B1 | | 11/2002 | Smith et al. | 124/77 |
| 6,516,791 | B2 | | 2/2003 | Perrone | 124/77 |
| 6,520,172 | B2 | | 2/2003 | Perrone | 124/74 |
| 6,618,975 | B1 | | 9/2003 | Shih | |
| 6,637,421 | B2 | | 10/2003 | Smith et al. | 124/77 |
| 6,644,295 | B2 | | 11/2003 | Jones | 124/77 |
| 6,644,296 | B2 | | 11/2003 | Gardner, Jr. | 124/77 |
| 6,698,128 | B2 | * | 3/2004 | Kessler | 42/76.01 |
| 6,725,841 | B1 | * | 4/2004 | Boecking | 123/467 |
| 6,763,822 | B1 | * | 7/2004 | Styles | 124/77 |
| 7,044,119 | B2 | * | 5/2006 | Jones | 124/74 |
| 2002/0096164 | A1 | | 7/2002 | Perrone | 124/77 |
| 2002/0170551 | A1 | | 11/2002 | Kotsiopoulos et al. | 124/54 |
| 2003/0005918 | A1 | | 1/2003 | Jones | 124/70 |
| 2004/0255923 | A1 | * | 12/2004 | Carnall et al. | 124/73 |
| 2005/0091901 | A1 | | 5/2005 | Perry et al. | |
| 2005/0115554 | A1 | | 6/2005 | Jones | |

FOREIGN PATENT DOCUMENTS

| | | | | |
|---|---|---|---|---|
| EP | AN94026535 | | | 2/1993 |
| GB | 2146416 | | | 4/1985 |
| GB | 2313655 | | | 12/1997 |
| JP | 62237308 | A | * | 10/1987 |
| JP | 1179898 | | | 7/1989 |
| JP | 7004892 | | | 1/1995 |
| WO | WO 97/26498 | | | 6/1997 |
| WO | WO 9901677 | A2 | * | 1/1999 |

OTHER PUBLICATIONS

Techno Paintball- information reviews articles forum auction and chat at http://www.technopaintball.com/matrixreview.htm 2pages.

* cited by examiner

PNEUMATIC PAINTBALL GUN

This application is a continuation-in-part of U.S. patent application Ser. No. 10/869,829 filed Jun. 15, 2004, the contents of which are incorporated herein by reference, in their entirety.

BACKGROUND OF THE INVENTION

1. Field of the Invention

This invention relates generally to pneumatic paintball guns ("markers") and their operating components. More particularly, this invention relates to a pneumatic paintball gun and the pneumatic components used to load a paintball into and fire it from the paintball gun.

2. Related Art

In the sport of paintball, it is generally desirable to have a marker that is as small and light as possible. Smaller and lighter markers increase a players' mobility. Players benefit from increased mobility by being able to move more quickly from bunker to bunker, making it easier to avoid being hit. Further, in the sport of paintball, the marker is treated as an extension of the body such that a hit to the marker counts as a hit to the player. It is desirable, therefore, to have a paintball gun with as small a profile as possible while substantially maintaining or improving performance characteristics of the marker, such as firing rate, accuracy, and gas efficiency. The size of the paintball gun is generally related to the size and number of operating components that must be housed within the paintball gun body.

It is further desirable to have a paintball marker that includes fewer, less complex, and less expensive, operating components and that can be more easily manufactured. The cost savings can then be passed on to the consumer. The industry is in need of a small, light, and inexpensive paintball marker that provides reliable and efficient operation.

SUMMARY OF THE INVENTION

In one embodiment of the present invention, a pneumatic paintball gun can include a body and a grip frame. The body and the grip frame can be formed separately or integrally, and are preferably formed from a molded plastic, rubber, or other rugged but relatively inexpensive material. The body preferably includes a chamber configured to receive a pneumatic assembly. The pneumatic assembly preferably provides several of the operating components of the paintball gun including a bolt, a compressed gas storage area, and a firing mechanism. A pneumatic assembly housing can be formed of metal, plastic, or a combination of materials and, in addition to housing the pneumatic components, can be configured to receive a barrel and a feed tube. A pneumatic regulator can also be provided and can, for example, be a vertical, in-line regulator or a bottom-mount regulator.

The bolt preferably includes a forward and a rearward piston surface area. A quantity of compressed gas is preferably selectively supplied and vented from a forward piston surface area through a mechanical or electro-pneumatic valving mechanism. The firing mechanism preferably consists of a sealing member arranged in selective communication with an outer surface of the bolt. One or more firing ports are preferably arranged in the bolt to communicate compressed gas through the bolt to launch a paintball. Compressed gas from the regulator can be supplied to the compressed gas storage area through a supply port. The flow of compressed gas into the compressed gas storage area can be restricted or prevented during a firing operation to increase gas efficiency of the paintball gun.

In operation, compressed gas is preferably supplied to the paintball gun from a compressed gas container through a pressure regulator. The compressed gas is preferably directed from the pressure regulator to the valving mechanism and to a supply port for feeding the compressed gas storage area. Compressed gas supplied to the valving mechanism is preferably transferred through the valving mechanism to the forward surface area of the bolt piston when the valving mechanism is in a neutral (non-actuated) position. This compressed gas acts on the forward bolt piston surface area to force the bolt into a rearward position. While the bolt is in a rearward position, a paintball is allowed to load into a breech of the paintball gun from the feed tube. In addition, while the bolt is rearward, the gas supply port is preferably allowed to rapidly transmit compressed gas into the compressed gas storage area.

A trigger mechanism is preferably configured to operate the valving mechanism. When the trigger is depressed, the valving mechanism is preferably actuated to vent compressed gas away from the forward piston surface area of the bolt. Compressed gas is preferably applied to a rearward surface area of the bolt piston. The rearward surface area of the bolt piston can be arranged, for example, in the compressed gas storage area or at a rearward end of the bolt. The compressed gas applied to the rearward surface area of the bolt piston can therefore be supplied from the compressed gas storage area or from a separate supply port. When the compressed gas is vented from the forward bolt piston surface area, the pressure applied to the rearward bolt piston surface area preferably causes the bolt to move to a forward position.

When the bolt transitions to its forward position, a sealing member of the firing mechanism preferably disengages from the bolt surface area, permitting compressed gas from the compressed gas storage area to enter the bolt firing ports and launch a paintball from the marker. In addition, with the bolt in the firing position, the flow of compressed gas into the compressed gas storage area can be restricted. This can be accomplished, for instance, by configuring a rearward portion of the bolt to reduce the area through which compressed gas travels from the supply port to the compressed gas storage area. Alternatively, the supply of compressed gas to the compressed gas storage chamber can be cut off completely to prevent compressed gas from entering the storage chamber during the firing operation. This can be accomplished, for instance, by closing off the gas supply port using sealing members on a rearward end of the bolt, using sealing members on a separate, independent piston, by pinching a gas supply tube, or using a separate valving mechanism.

The valving mechanism can be a solenoid valve (such as a three-way solenoid valve), a mechanical valve, or other valving mechanism. In the case of a solenoid valve, an electronic circuit is preferably provided to control the operation of the solenoid valve based on actuation of a trigger mechanism. A switch, such as a microswitch or other switching device, is preferably arranged in communication with the trigger to send an actuation signal to the electronic circuit in response to a pull of the trigger. A power source is also preferably provided to supply power to the electronic circuit and solenoid valve. The valving mechanism preferably vents compressed gas away from a forward bolt piston surface area in response to a firing signal from the circuit board. In the case of a mechanical valve, the mechanical valve preferably communicates with the trigger to vent the compressed gas away from the forward bolt piston surface area in response to a trigger pull.

In one embodiment, the bolt is preferably a free-floating bolt with balanced pressure applied to opposite ends of the bolt piston rod. This can be accomplished, for instance, by providing a vent channel from a rearward end of the bolt piston rod through to the forward end of the bolt. Alternatively, the chamber in communication with the rearward end of the bolt piston can be vented to atmosphere through a vent port arranged through the gun body.

According to another aspect of this invention, ribs or fins can be provided lengthwise on the bolt piston with firing channels arranged between the ribs to permit compressed gas to be released from the gun when the bolt is transitioned forward, while still maintaining the position of the sealing member in a retaining groove.

According to a further aspect of this invention, an interchangeable shell can form the outer portion of the paintball gun body surrounding the pneumatic components. The interchangeable shell can, for instance, be a plastic, metal, or composite material, but is preferably ABS plastic. A number of interchangeable shells can be provided of different shapes, colors, and body styles to permit a user to customize their gun to a desired appearance.

According to a still further aspect of this invention, an improved apparatus and method for grip mounting a circuit board can be provided. According to this method, one or more slots are preferably arranged in the grip frame to receive the circuit board. Most preferably, one slot is arranged on each side of the grip frame to receive opposing sides of the circuit board. The depth of the slots is preferably selected to arrange the circuit board in the appropriate location when the circuit board is fully inserted into the slots. In this embodiment, no tools or mounting screws are required to secure the circuit board in the paintball gun, thereby reducing the cost of parts and the cost of manufacturing. Manufacturing consistency is also improved. In addition, a solenoid valve can be mounted on the circuit board and arranged in the grip of the paintball gun. The circuit board can further include a trigger-actuated microswitch arranged on the circuit board, preferably on an opposite side of the circuit board from the solenoid valve.

According to another aspect of the present invention, a method of mounting a paintball detection system is provided. According to this method, a mounting slot is preferably arranged in a bottom portion of a pneumatic housing near a breech area of a paintball gun. Holes or slots are preferably arranged through one or more sidewalls of the pneumatic housing at the breech area. A paintball detection system circuit board is preferably mounted within the slot such that a sensor disposed on the circuit board can communicate with an interior of the breech area or with a sensor arranged on an opposite side of the pneumatic housing. The circuit board is preferably shaped to fit within the mounting slot. If a break-beam sensor system is used, holes are preferably arranged in opposing sides of the pneumatic housing in proximity to the location of the break-beam sensors once installed in the pneumatic housing.

Various other aspects, embodiments, and configurations of this invention are also possible without departing from the principles disclosed herein. This invention is therefore not limited to any of the particular aspects, embodiments, or configurations described herein.

BRIEF DESCRIPTION OF THE DRAWINGS

The foregoing and additional objects, features, and advantages of the present invention will become more readily apparent from the following detailed description of preferred embodiments, made with reference to the accompanying figures, in which.

DETAILED DESCRIPTION OF PREFERRED EMBODIMENTS

Figure 1:
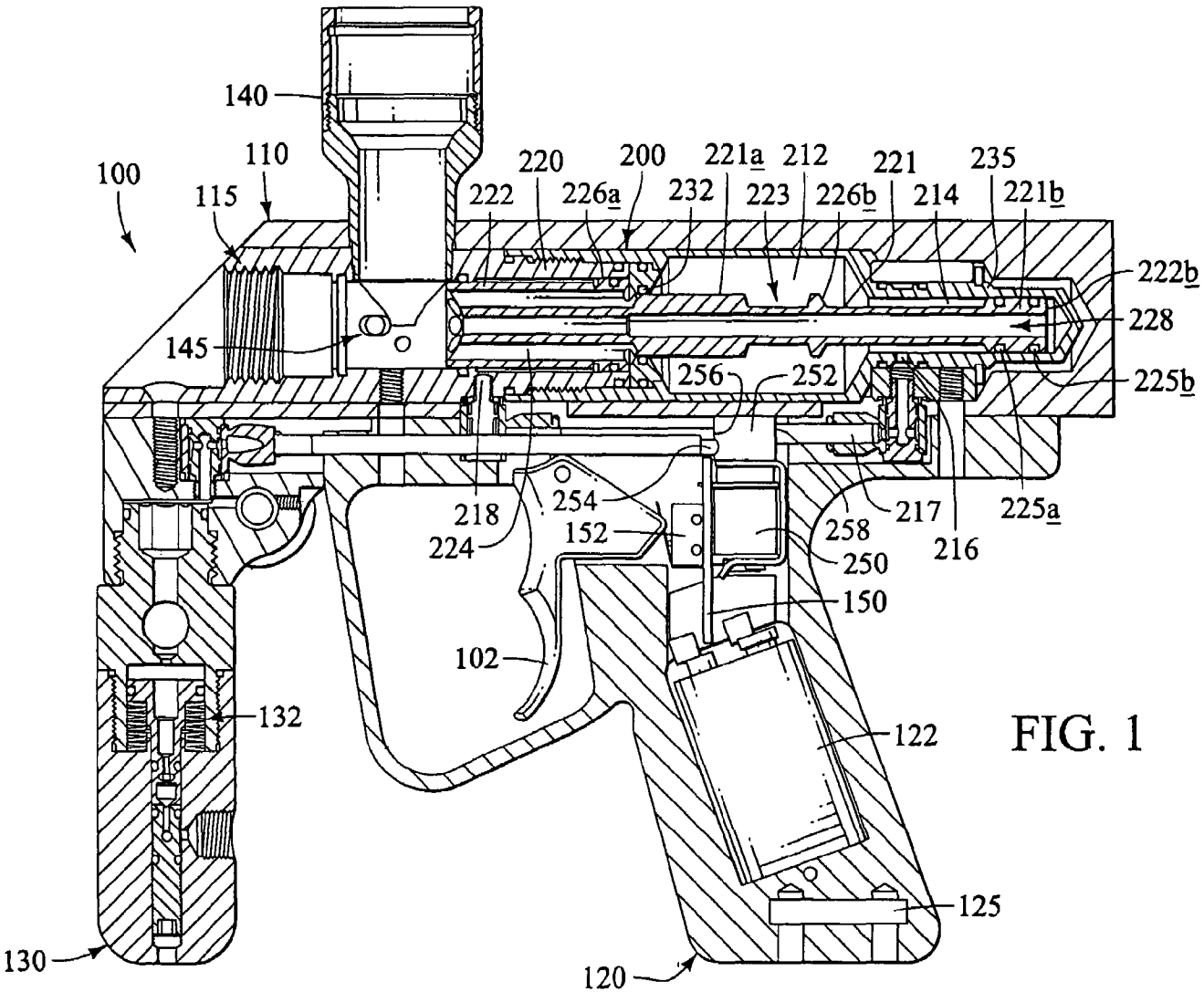
FIG. 1 is a somewhat schematic cross-sectional side view of a paintball gun, shown with a bolt thereof in an rearward (e.g., open) position, according to certain principles of the present invention.

The accompanying drawings show the construction of various preferred embodiments incorporating principles of the present invention. Referring to FIG. 1, a pneumatic paintball gun 100 can be constructed having a body 110 and a grip 120. A foregrip 130 can also be provided. The body 110 and the grip 120 can be formed integrally or separately and can be formed of the same or different materials. The body 110 and the grip 120 are preferably formed of a molded plastic or rubber material, such as ABS plastic, that is durable and shock resistant yet relatively inexpensive.

A pneumatic housing 115 is preferably arranged in the body 110 to house some or all of the pneumatic components, to receive a barrel (not shown), and to receive a feed tube 140. The pneumatic housing 115 is preferably a block or tube formed from a metal such as aluminum, but can be formed of any other metal, plastic, or other material that is sufficiently durable to perform its required functions. The grip 120 and foregrip 130 are preferably secured to the body 110 and the pneumatic housing 115 using screws or other fastening means. A plate 125 is also preferably provided and formed of a rigid material, such as metal, can also be arranged in the grip 120 to permit secure attachment of a tank receptacle (not shown) for connecting to a compressed gas tank.

The foregrip 130 preferably provides a regulator 132 for regulating a supply of compressed gas down to a desired operating pressure. In this embodiment, the desired operating pressure is between about 90 to 350 psi. A battery 122 can be arranged in the grip 120 along with a circuit board 150 and a solenoid valve 250. The solenoid valve 250 of this embodiment is preferably a normally-open, three-way solenoid valve.

A pneumatic assembly 200 is preferably arranged in the body 110 and can be connected to and/or include some or all of the pneumatic housing 115. The pneumatic assembly 200 preferably includes a compressed gas storage area 212, a pneumatic cylinder 220, and a guide chamber 214. A bolt 222 is preferably slidably arranged having a first piston surface area 226*a* located within a pneumatic cylinder 220 in a piston and cylinder assembly. The bolt 222 may further include a guide rod 221 that extends through substantially the entire pneumatic assembly 200.

The guide rod 221 can include a firing valve section 221*a* that communicates with a sealing member 232 to prevent compressed gas from entering the bolt 222 from the compressed gas storage area 212 when the bolt 222 is rearward. The guide rod 221 further preferably includes a rearward section 221*b* that slides back and forth within a guide chamber 214 to provide stability for the bolt and also to restrict or prevent the flow of compressed gas into the compressed gas storage area 212 from a supply port 216 when the bolt 222 is forward. A vent channel 228 may be provided through the bolt 222 and guide rod 221 to prevent back pressure from building up on a rearward end 222*b* of the bolt 222 and provide an essentially free-floating bolt arrangement. This reduces the amount of pressure required to recock the bolt 222. The vent channel also reduces the amount of force applied by a forward end 222*a* of the bolt 222 on a paintball, improves gas efficiency, and eliminates the need for a secondary pressure regulator. Alternatively, a vent channel (not shown) may be provided through the body 110 of the gun 100 to vent the rearward chamber area 214 to atmosphere.

With the bolt 222 in an open position, compressed gas from the regulator 132 is supplied to the compressed gas storage area 212 through the supply port 216. The sealing member 232 preferably communicates between an external surface of the bolt 222 along the firing valve section 221*a* and an inner wall of the pneumatic assembly 200 to prevent compressed gas from entering the bolt 222. The sealing member 232 can, for example, be arranged in a recess of the inner wall (or protrusion from the inner wall) of the pneumatic assembly 200 near a forward end of the compressed gas storage chamber 212.

Alternatively, for example, a bolt port can be arranged through the bolt 222, with an input disposed near a rearward end of the bolt 222, to communicate compressed gas from a rearward end of the compressed gas storage area 212 through the bolt 222 and into communication with a paintball when the bolt transitions to its forward position. In this embodiment, the sealing member 232 could be arranged on the bolt 222 near a rearward end of the compressed gas storage area 212 so as to prevent compressed gas from entering the bolt 222 from the compressed gas storage area 212 when the bolt 222 is open, but to permit compressed gas from the compressed gas storage area 212 to enter the bolt 222 when the bolt is closed.

The solenoid valve 250 preferably selectively supplies compressed gas to and vents compressed gas from the cylinder 220 through the port 218 to move the bolt 222. The solenoid valve 250 preferably comprises a normally-open configuration where compressed gas input into the solenoid valve 250 through an input port 254 is supplied via an output port 256 to the forward piston surface area 226*a* of the bolt 222 to hold the bolt 222 in an open position.

Figure 9:
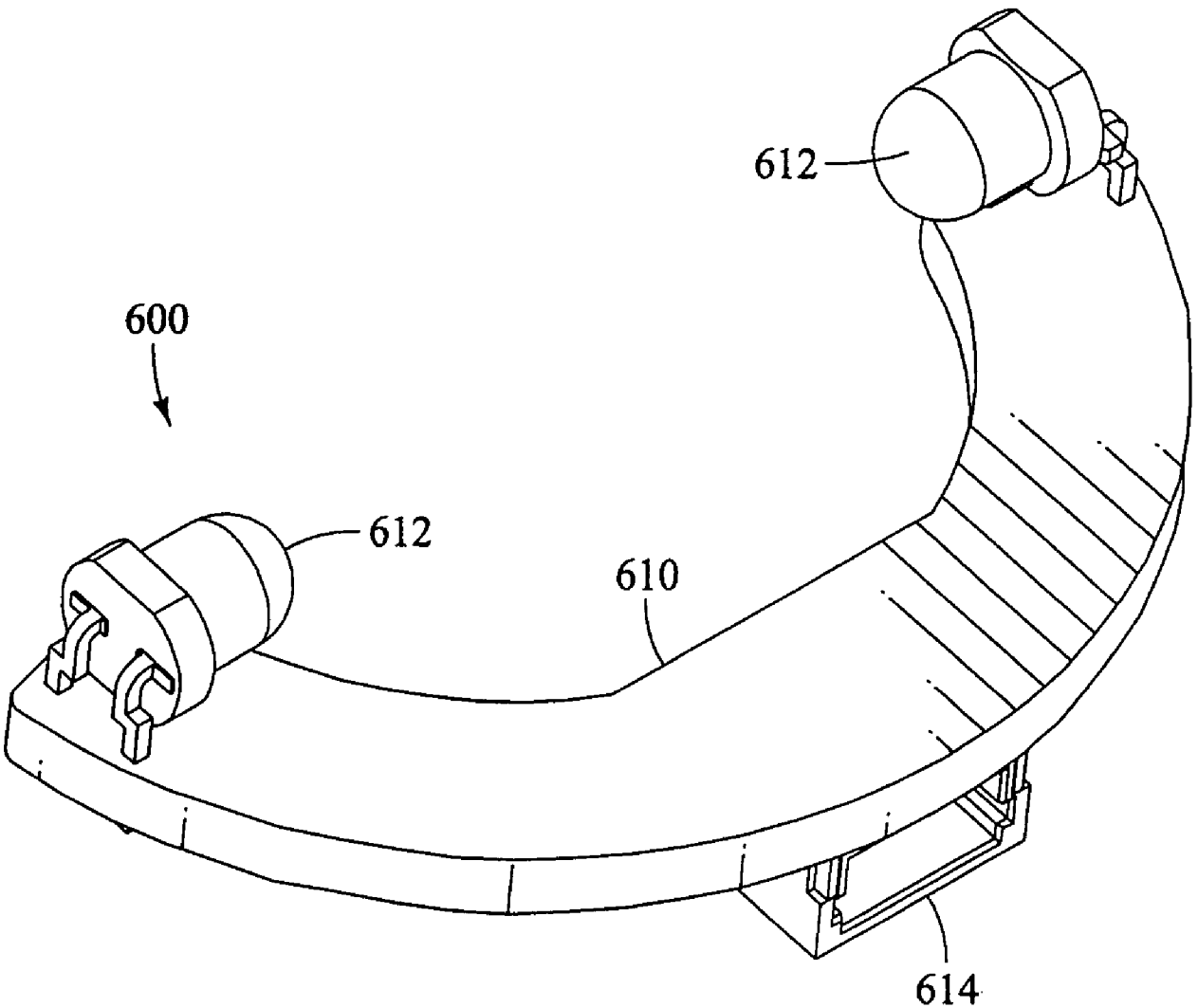
FIG. 9 is a somewhat schematic perspective view of a circuit board and sensor system for the paintball detection system configured for arrangement in the breech section of the paintball gun illustrated in FIGS. 6, 7, and 8.

In response to a trigger pull, a firing signal is preferably sent from the circuit board 150 to the solenoid valve 250 to initiate a firing operation of the paintball gun 100. In response to the firing signal, the solenoid valve 250 preferably vents compressed gas away from the forward piston area 226*a* of the bolt 222. Pressure on an opposing surface area 226*b* of the bolt 222 thereby causes the bolt 222 to transition to a closed position, as shown in FIG. 9. The opposing surface area 226*b* can, for instance, be arranged in the compressed gas storage area 212 as 20 shown in FIGS. 1 and 2.

Alternatively, the opposing surface area 226*b* can be arranged on a rearward end 222*b* of the bolt 222, with compressed gas supplied to the rearward end 222*b* of the bolt 222 through a separate supply channel (not shown). In this alternative embodiment, the vent channel 228 would be omitted to maintain pressure in chamber 214 to function as an air spring. The opposing surface area 226*b* could likewise be positioned anywhere else where it can receive a quantity of compressed gas to force the bolt 222 into a closed position when gas is vented away from the forward surface area 226*a*. The opposing surface area 226*b* preferably has a surface area less than that of the forward surface area 226*a* to prevent the bolt from moving forward until the compressed gas is vented away from the forward surface area 226*a*. Alternatively, a mechanical spring or other biasing member that provides a desired amount of force (preferably less than the amount of force created by the compressed gas on the forward surface area of the bolt 226*a*) could be used to force the bolt 222 into a closed position when compressed gas is vented away from the forward surface area 226*a* of the bolt 222.

Figure 2:
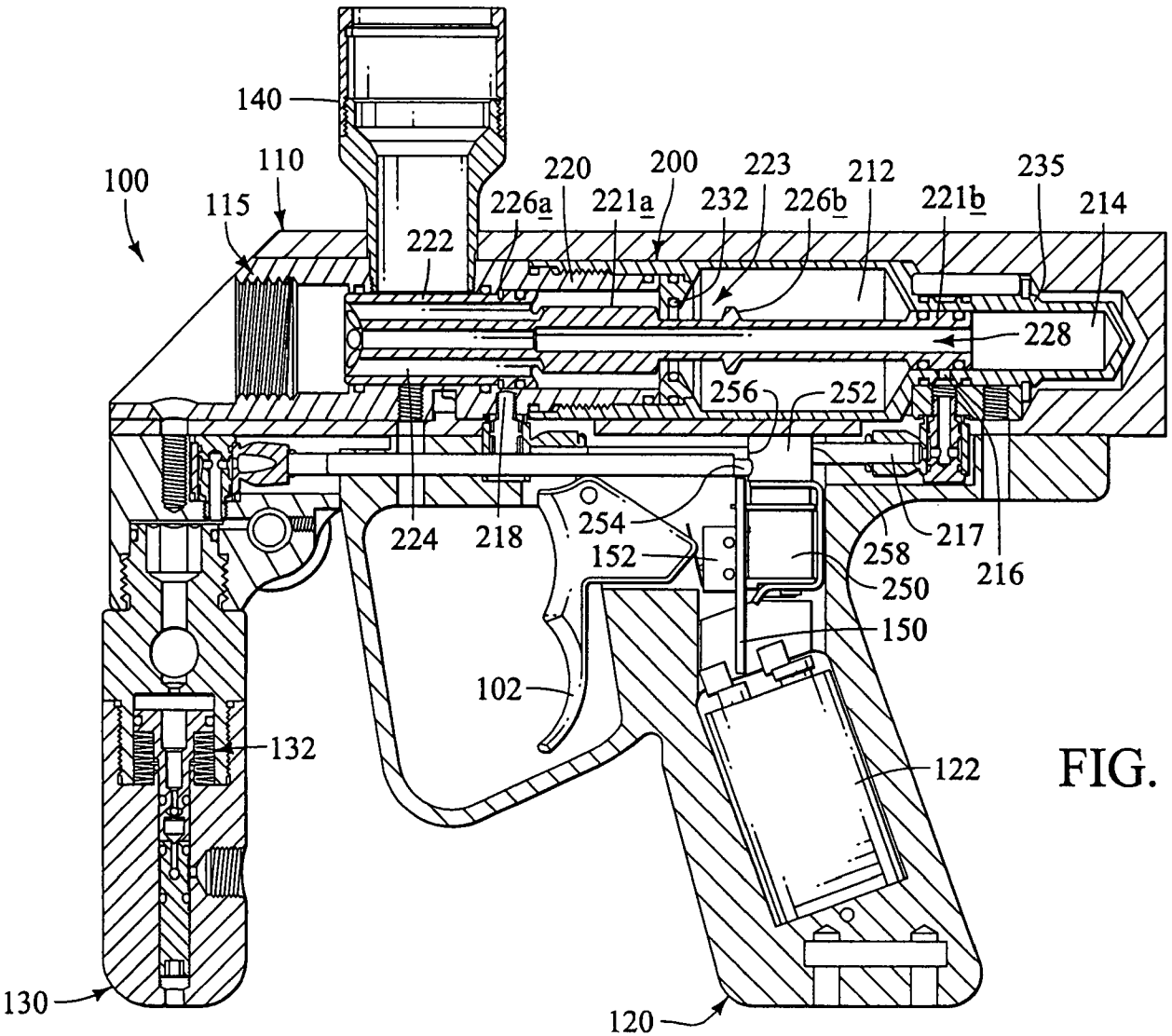
FIG. 2 is a somewhat schematic cross-sectional side view of the paintball gun of FIG. 1, shown with the bolt is disposed in a forward (e.g., closed) position.

Referring now to FIG. 2, with the bolt 222 in the closed position, compressed gas from the compressed gas storage area 212 is permitted to flow into the bolt 222 through channels 223 arranged along an external surface of the bolt 222 and ports 224 arranged to communicate compressed gas from a predetermined location along the exterior of the bolt 222 to a forward end of the bolt 222*a*. While the bolt 222 is in its forward position, entry of compressed gas into the compressed gas storage area 212 from the supply port 216 can be restricted using a glide ring 225*a* arranged on the rearward section of the guide rod 221*b* near a rearward end 222*b* of the bolt 222. A sealing member 225*b* prevents compressed gas from entering the rearward portion of the guide chamber 214 and the vent channel 228. To prevent (rather than restrict)

compressed gas from entering into the chamber during the firing operation, the glide ring 225*a* could be replaced by a sealing member (not shown).

Figure 3:
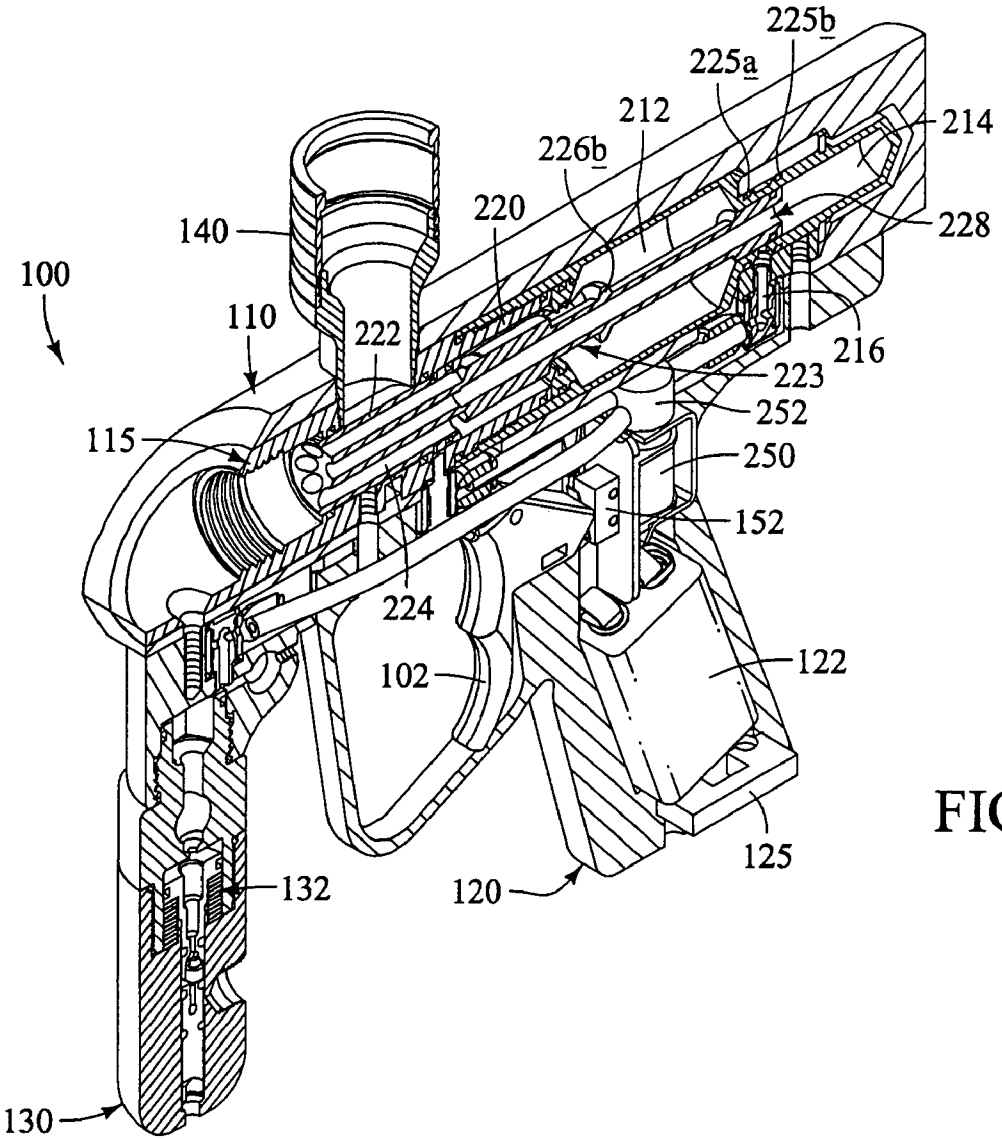
FIG. 3 is a somewhat schematic cross-sectional perspective view of the pneumatic paintball gun illustrated in FIG. 2.

Loading and firing operations of the pneumatic paintball gun 100 will now be described in further detail with reference to FIGS. 1-3. Referring to FIGS. 1, 2, and 3, compressed gas supplied from the regulator 132 to the paintball gun 100 is directed to a manifold 252 arranged in communication with the solenoid valve 250. Compressed gas from the regulator 132 is directed through the manifold to an inlet 254 of the solenoid valve 250. In its normally-open position, the solenoid valve 250 directs compressed gas from the input port 254 to an output port 256 of the manifold 252 to the cylinder 220 and hence the forward bolt piston surface area 226*a*.

Meanwhile, compressed gas from the regulator 132 is also supplied through a second output port 258 of the manifold 252 to a supply port 216, preferably arranged near a rearward end of the compressed gas storage area 212 in a bolt guide cylinder 235. While the bolt 222 is open, compressed gas from the supply port 216 is preferably permitted to rapidly fill the compressed gas storage area 212. A rearward piston surface area 226*b* of the bolt 222 is preferably arranged in or in communication with the compressed gas storage area 212. The forward bolt piston surface area 226*a* is preferably larger than the rearward surface area 226*b*. Thus, in its resting position (e.g., in the absence of a firing signal), the compressed gas supplied to the forward bolt piston surface area 226*a* holds the bolt 222 in an open position against pressure applied to a rearward bolt piston surface area 226*b*. With the bolt 222 in its open (e.g., rearward position), a paintball is permitted to drop from a feed tube 140 into a breech area 145 of the paintball gun 100.

A firing operation of the paintball gun 100 is preferably initiated in response to actuation of a trigger 102. The trigger 102 is preferably configured to initiate a firing operation of the paintball gun 100 through actuation of a microswitch 152 or other switching mechanism when pulled. Actuation of the switching mechanism 152 preferably causes the circuit board 150 to initiate a firing operation by transmitting one or more firing signals to the solenoid valve 250. In the embodiment illustrated in FIGS. 1, 2, and 3, the firing signal is preferably an actuation signal that energizes the solenoid of the solenoid valve 250 for a predetermined duration of time. The trigger 102 could be configured, however to actuate a firing sequence as long as the trigger 102 is pulled, particularly if a mechanical rather than electronic actuation system is utilized.

In response to the firing signal, the solenoid valve 250 preferably vents compressed gas from the forward bolt piston area 226*a*. Pressure applied from the compressed gas storage area 212 to the rearward bolt piston area 226*b* thereby causes the bolt 222 to move to its forward position. As the bolt 222 transitions to its forward position, it forces a paintball that has been loaded in the breech area 145 forward into the rearward end of a barrel (not shown).

In addition, as the bolt 222 approaches its forward position, the channels 223 arranged along the external surface of the bolt 222 slide past the sealing member 232 and allow the compressed gas from the compressed gas storage area 212 to enter into the rearward portion of the cylinder 220. Compressed gas in the rear of the cylinder 220 flows through bolt ports 224 into contact with the paintball in the barrel to cause it to be launched from the gun 100. Also, as the bolt 222 approaches its forward position, a glide ring or sealing member 225*a* slides past the gas supply port 216 to respectively restrict or prevent the flow of compressed gas from the regulator 132 into the compressed gas storage area 212. This can improve the gas efficiency of the paintball gun 100.

Although the embodiment of FIGS. 1, 2, and 3 illustrates the use of an electro-pneumatic valve 250 to control the loading and firing operations of the paintball gun 100, a mechanical valve could be used in place of the solenoid valve 250. Like the solenoid valve 250, the mechanical valve could be configured to supply compressed gas to the forward piston surface area 226*b* through port 218 in a resting position. In response to a pull of the trigger 102, the mechanical valve could be configured to vent the compressed gas away from the forward piston surface area 226*b* to cause the bolt 222 to move forward and perform a firing operation. The trigger 102 could, for example, be directly mechanically coupled to the valve or could communicate with the mechanical valve through one or more intermediate components.

Figure 4:
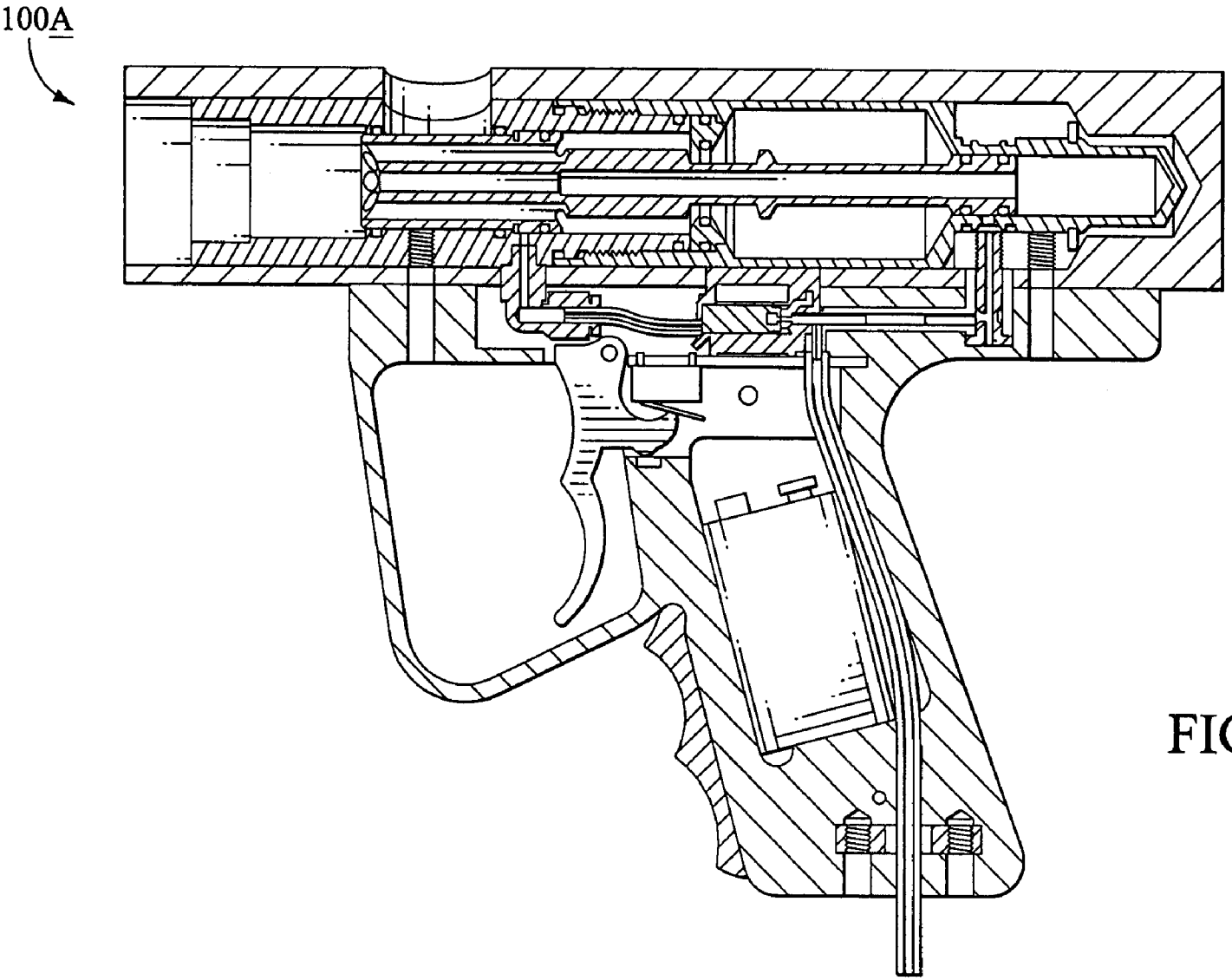
FIG. 4 is a somewhat schematic cross-sectional side view of a paintball gun constructed according to an alternative embodiment of the present invention.
Figure 5:
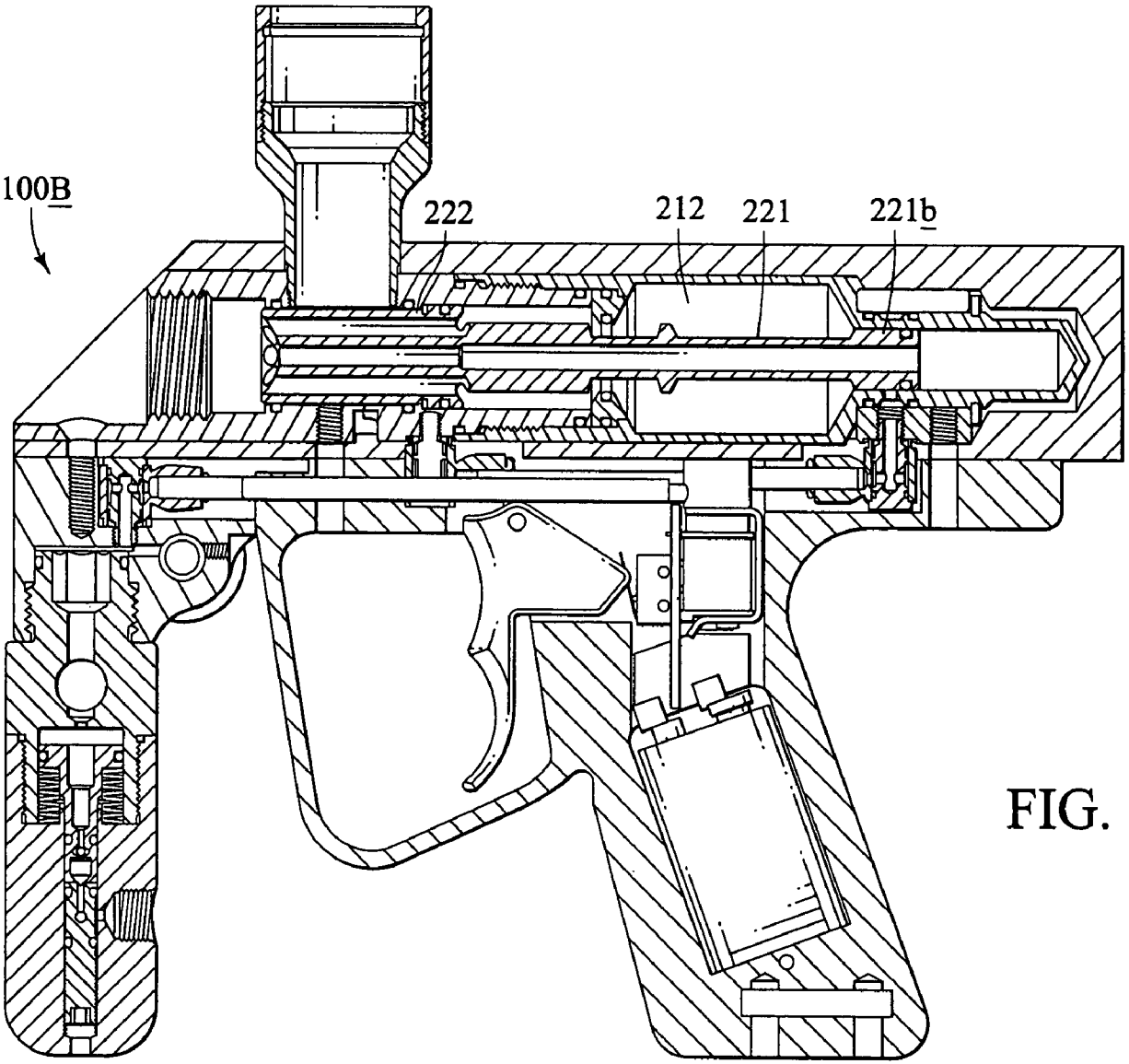
FIG. 5 is a somewhat schematic cross-sectional side view of a paintball gun constructed according to yet another embodiment of the present invention.

Yet other alternative embodiments of the present invention are shown in FIGS. 4 and 5. The paintball gun 100A shown in FIG. 4 is constructed in a manner similar to that shown in FIGS. 1, 2, and 3, except, for instance, the absence of a foregrip 130, compressed gas being supplied to the gun through a tube arranged through the grip 120, and that the solenoid valve 250 is arranged in a different physical relationship with respect to the gun body 110. The primary operating features of this embodiment are essentially the same as that previously described, however, and no additional description of this embodiment will therefore be provided.

The paintball gun 100B depicted in FIG. 5 is also similar to that depicted in FIGS. 1-3, except that the rearward end 221*b* of the guide rod 221 does not contain a glide ring or a sealing ring where the glide ring 225*a* is arranged in the earlier-described embodiment. As with the glide ring, compressed gas is permitted to enter the compressed gas storage chamber 212 even when the bolt is in its forward position. The tolerance between the guide rod 221 and the guide chamber 214 can be configured, however, such that the rate of flow of compressed gas into the compressed gas storage chamber 212 can be restricted while the bolt 222 is arranged in its forward position. This can result in improved gas efficiency and make the bolt 222 easier to move to its retracted position.

Various other alternative embodiments are also contemplated. In particular, rather than use a portion of the bolt 222 to restrict or prevent compressed gas from entering the compressed gas storage area 212, other mechanisms could be used to provide this function. For example, a separate piston could be arranged to slide back and forth in the rearward bolt guide area to block or restrict the supply of compressed gas from the supply port 214 into the compressed gas storage area 212. In yet another potential embodiment, a mechanical, pneumatic, or electro-pneumatic pinching member could be provided to pinch a gas supply tube (e.g., tube 217) to prevent or restrict the flow of compressed gas into the compressed gas storage area 212 while the bolt 222 is in the forward position.

Figure 6:
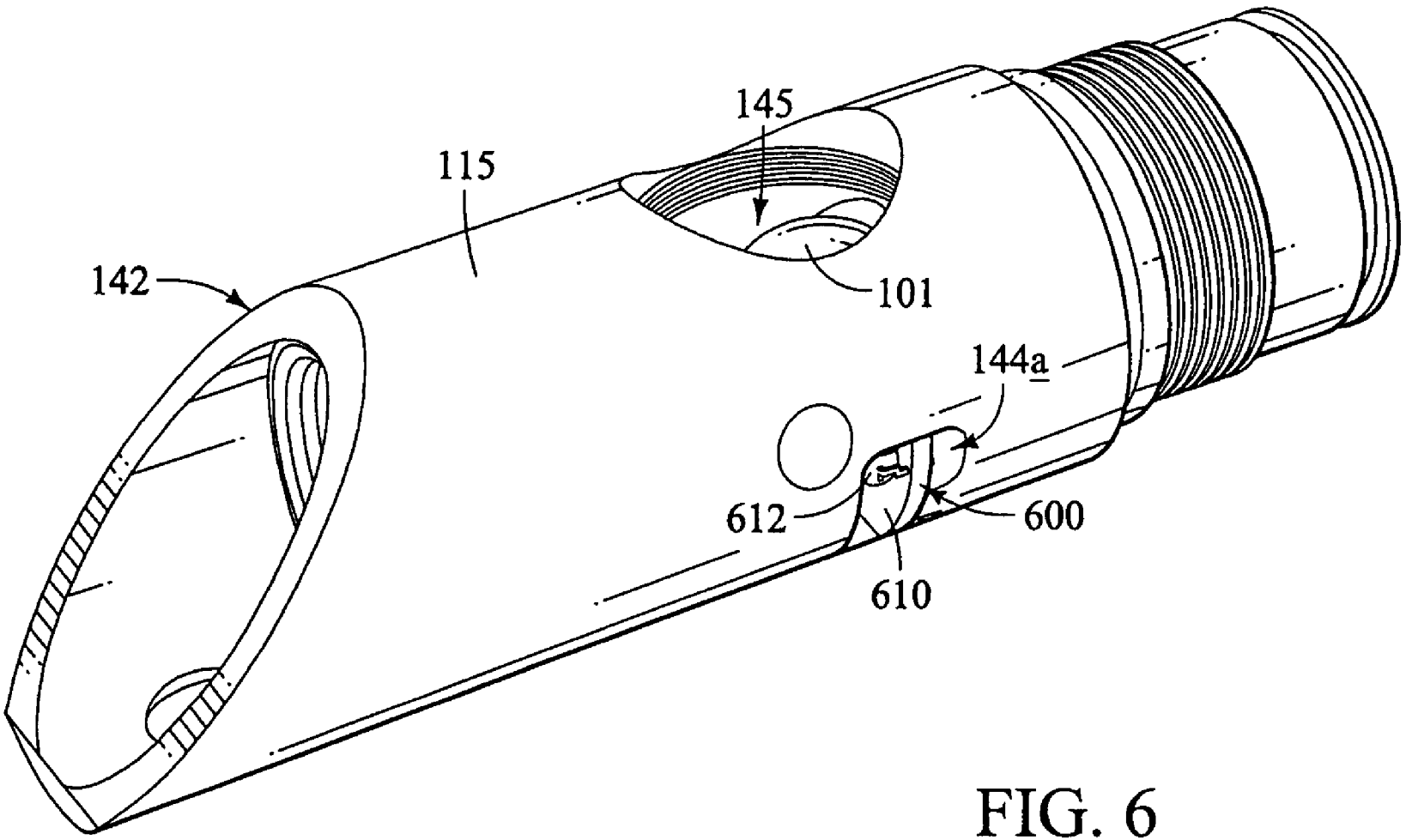
FIGS. 6, 7, and 8 are a somewhat schematic perspective, cross-sectional side, and bottom plan view, respectively, illustrating a paintball detection system arrangement in a breech section of a paintball gun according to yet another embodiment of the present invention.
Figure 7:
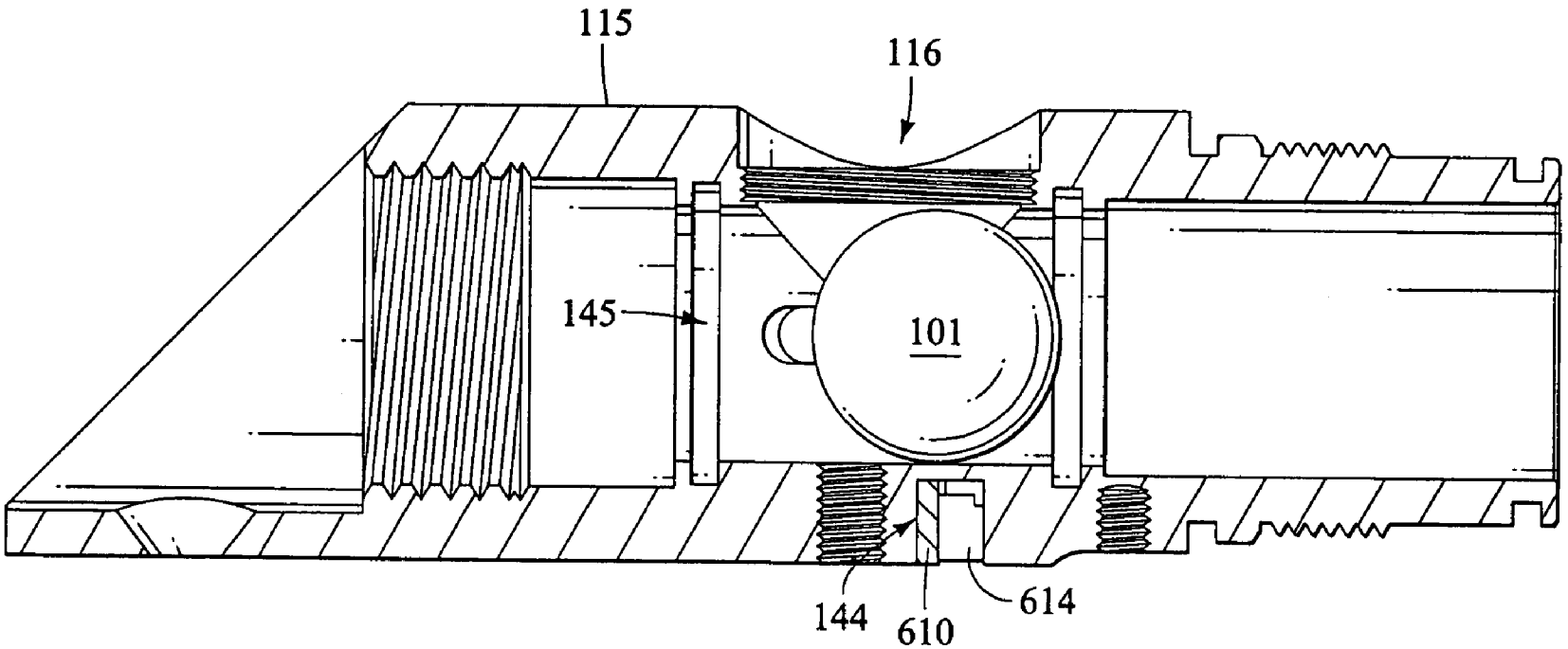
Figure 8:
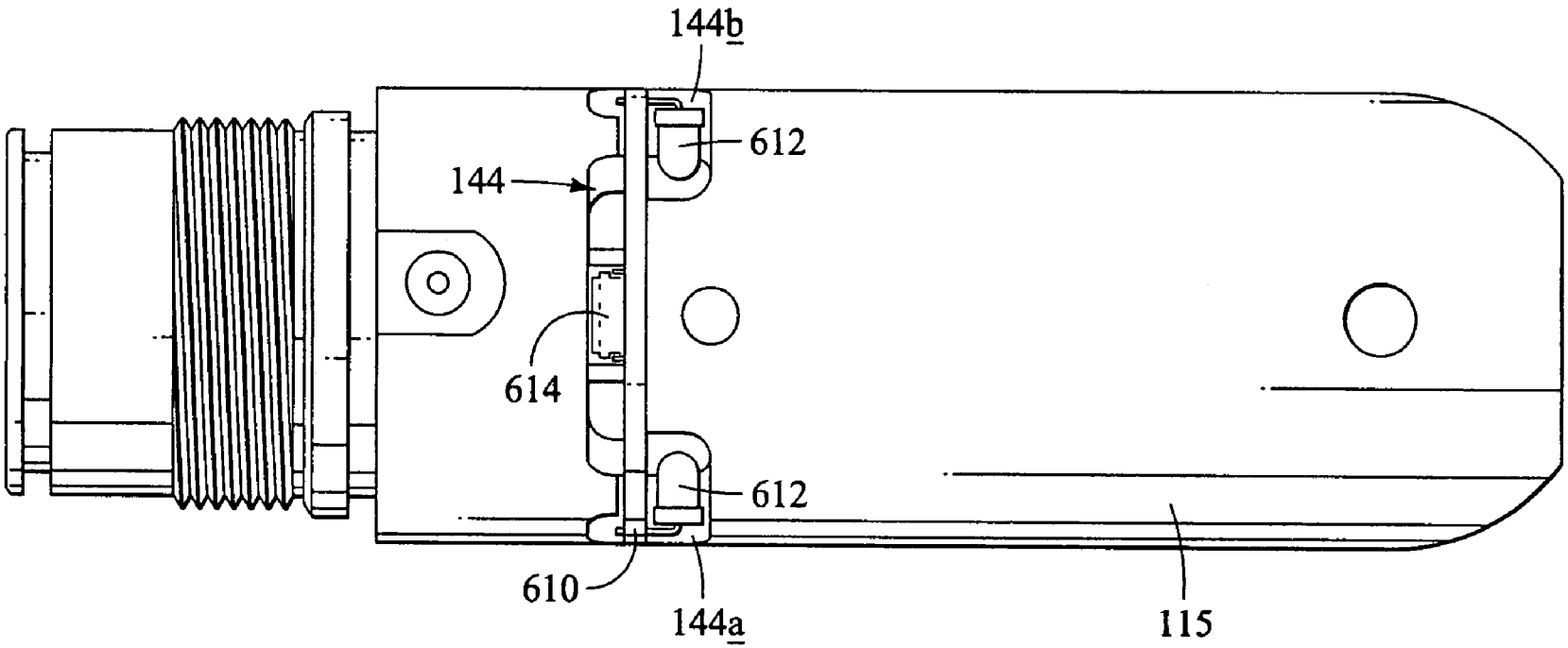

Further aspects of the present invention are illustrated in FIGS. 6, 7, and 8. Referring to FIGS. 6-9, a paintball detection system 600 can be arranged in communication with a breech area 145 of the paintball gun 100 (see FIG. 1). Most preferably, the paintball detection system 600 contains a break-beam sensor arrangement on a circuit board 610. A breech portion 142 of the pneumatic housing 115 of the paintball gun 100 is preferably provided with a recess or a cutout area 144 to receive the circuit board and opposing cutout regions 144*a*, 144*b* located on opposite sides of the breech area 145 that are configured to receive the break-beam sensors 612.

A preferred circuit board 610 and sensor 612 arrangement for the paintball detection system 600 of FIGS. 6, 7, and 8 is shown in FIG. 9. Referring to FIG. 9, the circuit board 610 preferably comprises the circuitry for controlling the break-beam or other sensors 612 and an electronic communications port 614 for communicating with a circuit board 150 of the paintball gun 100 (see FIG. 1) through wiring or wirelessly. The sensors 612 can be mounted directly to the circuit board 610, as illustrated, or can be connected remotely via wires or wirelessly. In a preferred embodiment, the circuit board 610 is configured having a "C" shape with sensors 612 arranged on opposite arms of the circuit board 610. The circuit board 610 is preferably configured to fit within a recess or cutout 144 in the pneumatic housing and locate the sensors 612 within sensor cutout regions 144*a*, 144*b* in the pneumatic housing 115 on opposite sides of the breech area 145. In the preferred break-beam sensor embodiment, the sensors 612 are preferably configured such that one transmits a beam (or other optical or radio signal) to the other sensor 612 until that signal is interrupted by the presence of a paintball 101 in the breech area 145.

Operation of the paintball detection system 600 according to the foregoing embodiment will now be described in further detail with reference to FIGS. 1 and 6-9. Referring to FIGS. 6-9, with the bolt 222 arranged in a rearward position, a paintball 101 is preferably permitted to drop from the feed tube 140 into the breech area 145 of the paintball gun 100 through the feed tube opening 116. As the paintball 101 enters the breech area 145, it breaks a beam transmitted from one of the sensors 612 to the opposing sensor 612. A signal is then preferably generated by the detection system circuit board 610 to indicate that a paintball 101 has been loaded into the paintball gun 100. Alternatively, the detection system circuit board 610 could be configured to send a signal corresponding to the absence of a paintball 101 from the breech area 145.

The detection system circuit board 610 therefore preferably communicates a signal to the paintball gun circuit board 150 to indicate either the presence or the absence of a paintball 101 in the breech area 145 of the paintball gun 100. In response to this signal, the paintball gun circuit board 150 can preferably be configured to either execute or refrain from executing a firing operation in response to a trigger pull. More specifically, if the detection system circuit board 610 indicates the absence of a paintball 101 from the breech area 145 of the paintball gun 100, the paintball gun circuit board 150 is preferably configured to refrain from executing a firing operation in response to a trigger pull. If a paintball 101 is detected in the breech area 145 of the paintball gun 100, however, the paintball gun circuit board 150 is preferably configured to execute the firing operation in response to a trigger pull.

Figure 10:
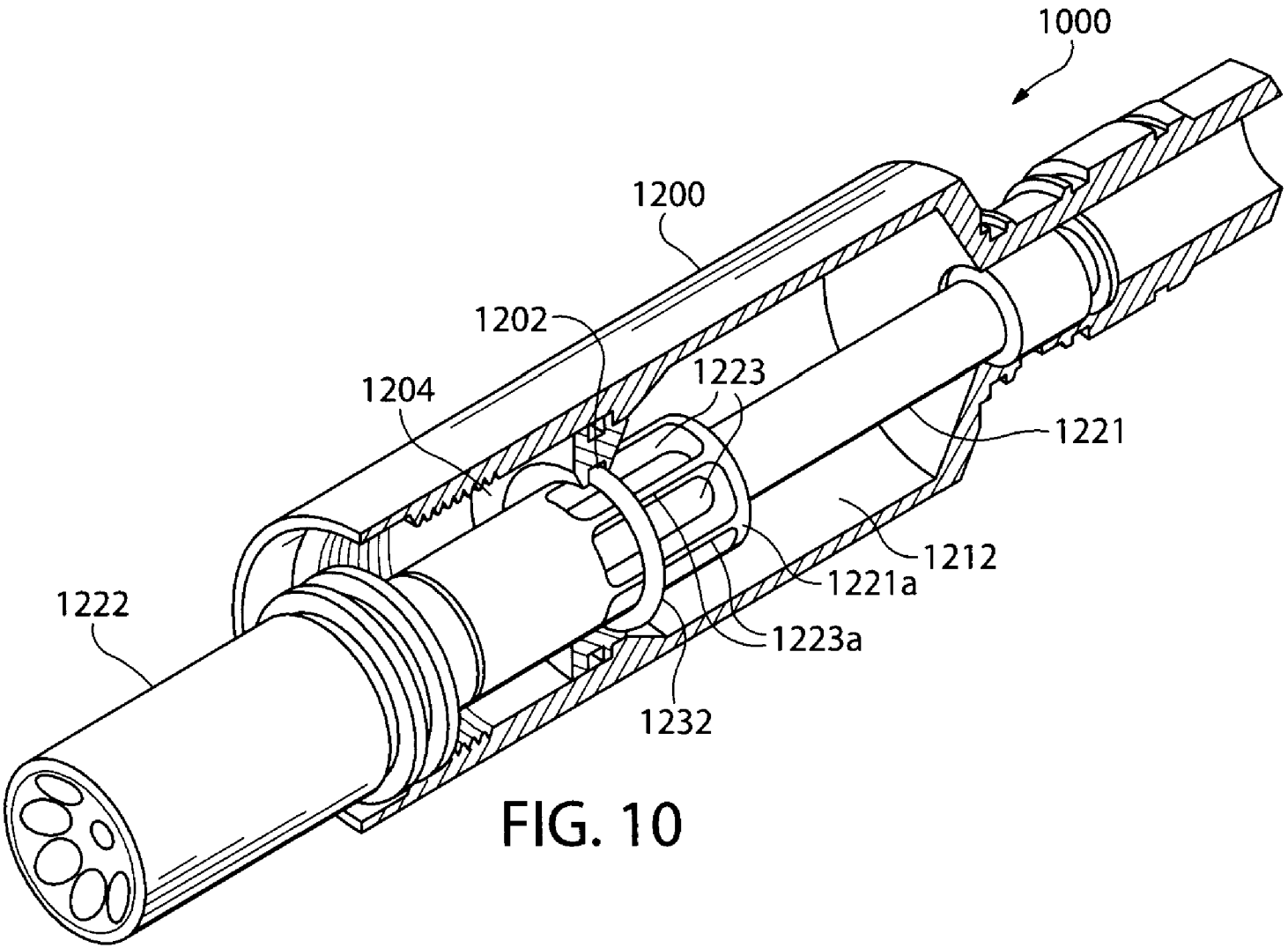
FIG. 10 is a somewhat schematic perspective cross-sectional view of a pneumatic assembly capable of use in the paintball gun of FIG. 1, according to another aspect of the present invention.

FIG. 10 is a somewhat schematic perspective cross-sectional view of a pneumatic assembly 1000 having a pneumatic housing 1200 and illustrating another aspect of the present invention. Referring to FIG. 10, a plurality of ribs (or fins) 1223*a* can be formed along a firing valve area 1221*a* of the bolt rod 1221 to retain an O-ring 1232 (or other sealing member) in position during a firing operation of the paintball gun (or other pneumatic launching device). As shown, an O-ring 1232 is preferably retained in an O-ring retaining groove 1202 in an O-ring retaining member 1204 to provide a sealing member for selectively preventing and permitting compressed gas to enter the bolt 1222 from a compressed gas storage area 1212. In this embodiment, when the bolt 1222 is in a rearward position, the O-ring 1232 seals around an outer surface of the firing valve area 1221*a* of the bolt rod 1221 to prevent compressed gas from escaping into the bolt 1222. When the bolt 1222 transitions to a forward position during a firing operation, however, firing grooves 1223 arranged between the ribs 1223*a* preferably permit compressed gas to escape from the compressed gas storage area 1212 into the bolt 1222 to be released from the paintball gun and launch a paintball. At the same time, however, the ribs 1223*a* prevent the O-ring 1232 from being unseated from its retaining groove 1202 and collapsing into the firing grooves 1223.

Figure 11:
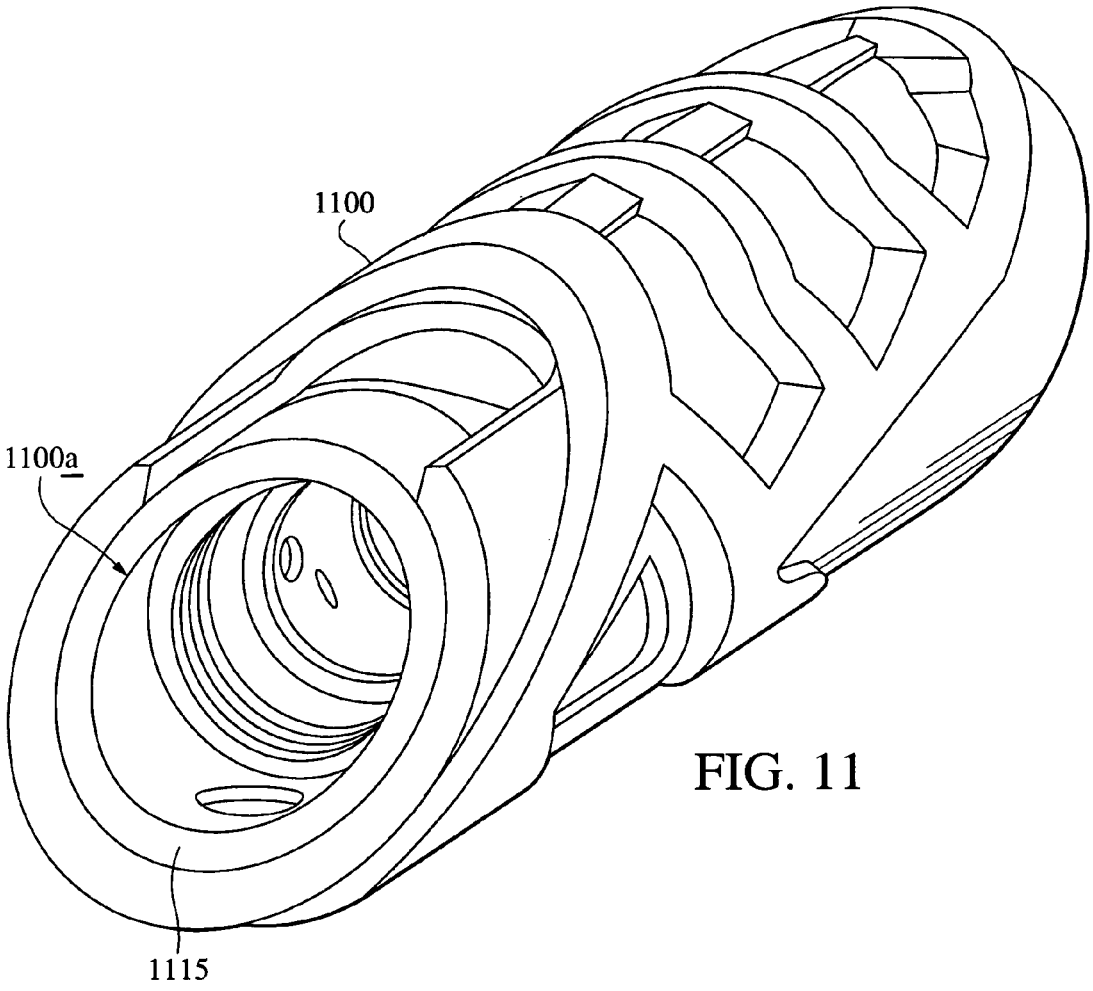
FIG. 11 is a somewhat schematic perspective view of a paintball gun body having an interchangeable external shell, according to yet another aspect of the present invention.
Figure 12:
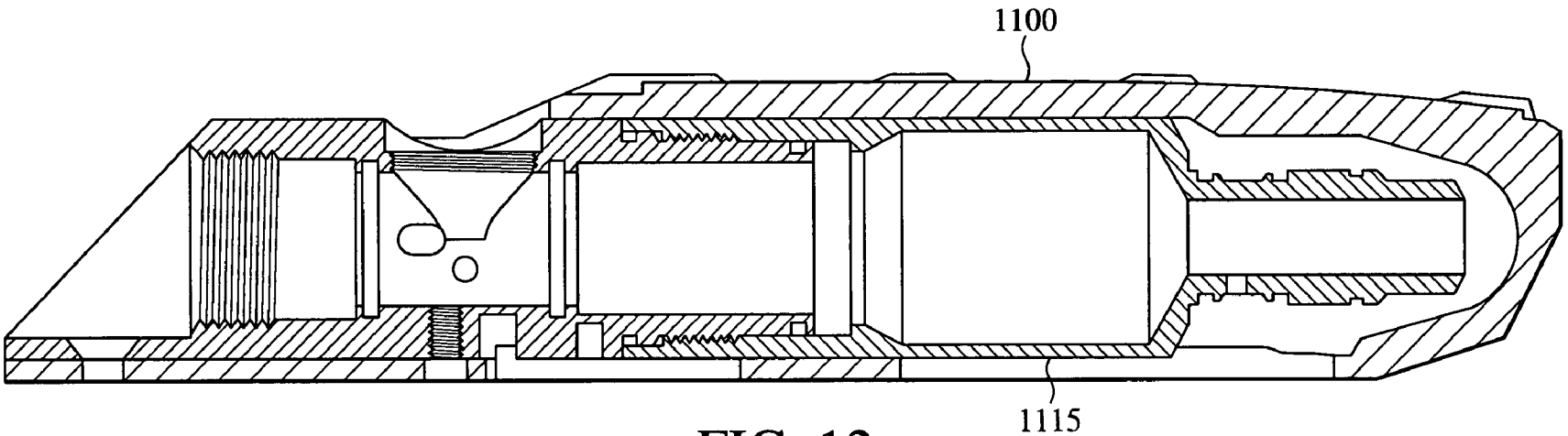
FIG. 12 is a somewhat schematic cross-sectional side view of a paintball gun body with an interchangeable external shell, as shown in FIG. 11.
Figure 13A:
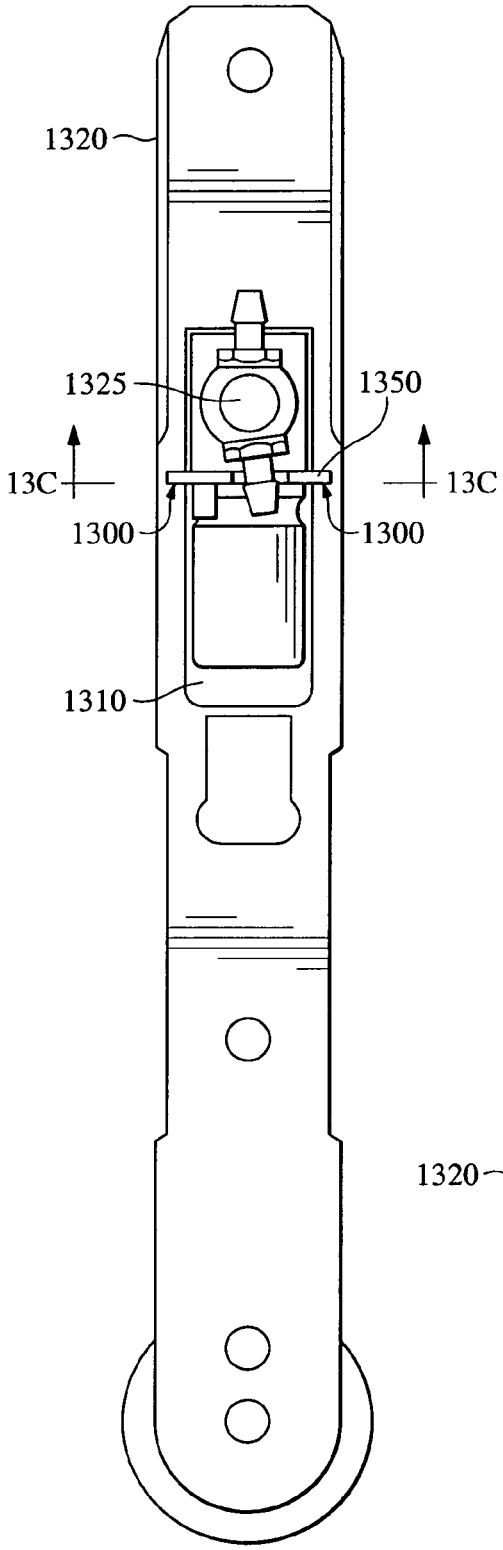
FIG. 13A is a somewhat schematic top view of a paintball gun grip frame configured to receive a grip-mounted circuit board according to a still further aspect of the present invention.
Figure 13B:
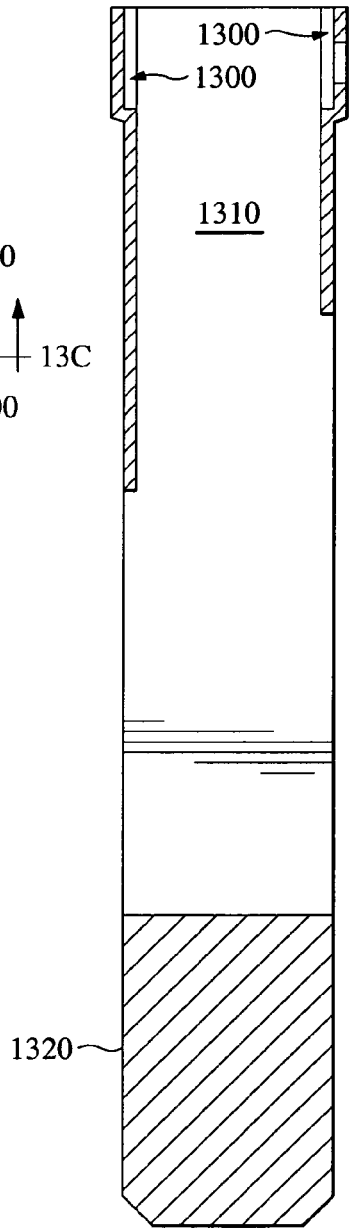
FIG. 13B is a somewhat schematic cross-sectional view of the paintball gun grip frame of FIG. 13A, illustrating a slot configured to receive a grip-mounted circuit board according to another aspect of the present invention.
Figure 13C:
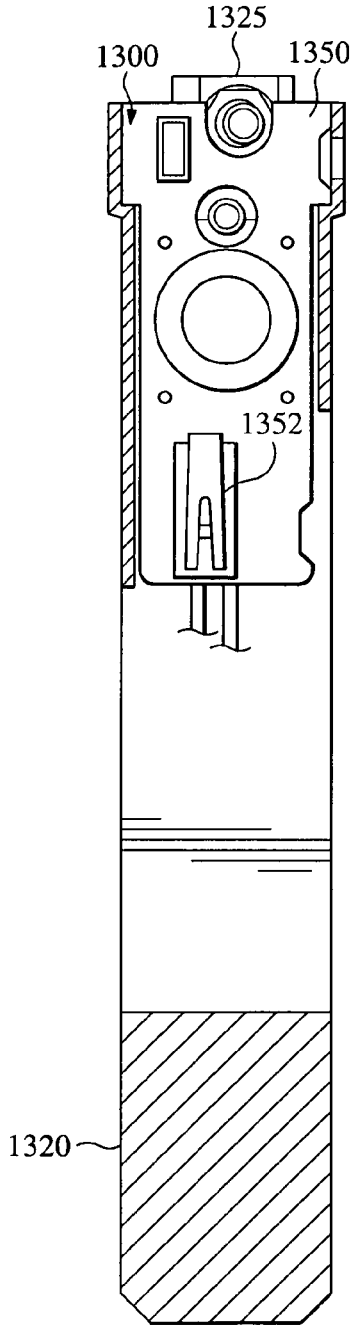
FIG. 13C is a somewhat schematic cross-sectional view of the paintball gun grip frame of FIG. 13A, illustrating a grip-mounted circuit board arranged in the slot of FIG. 13B.
Figure 14:
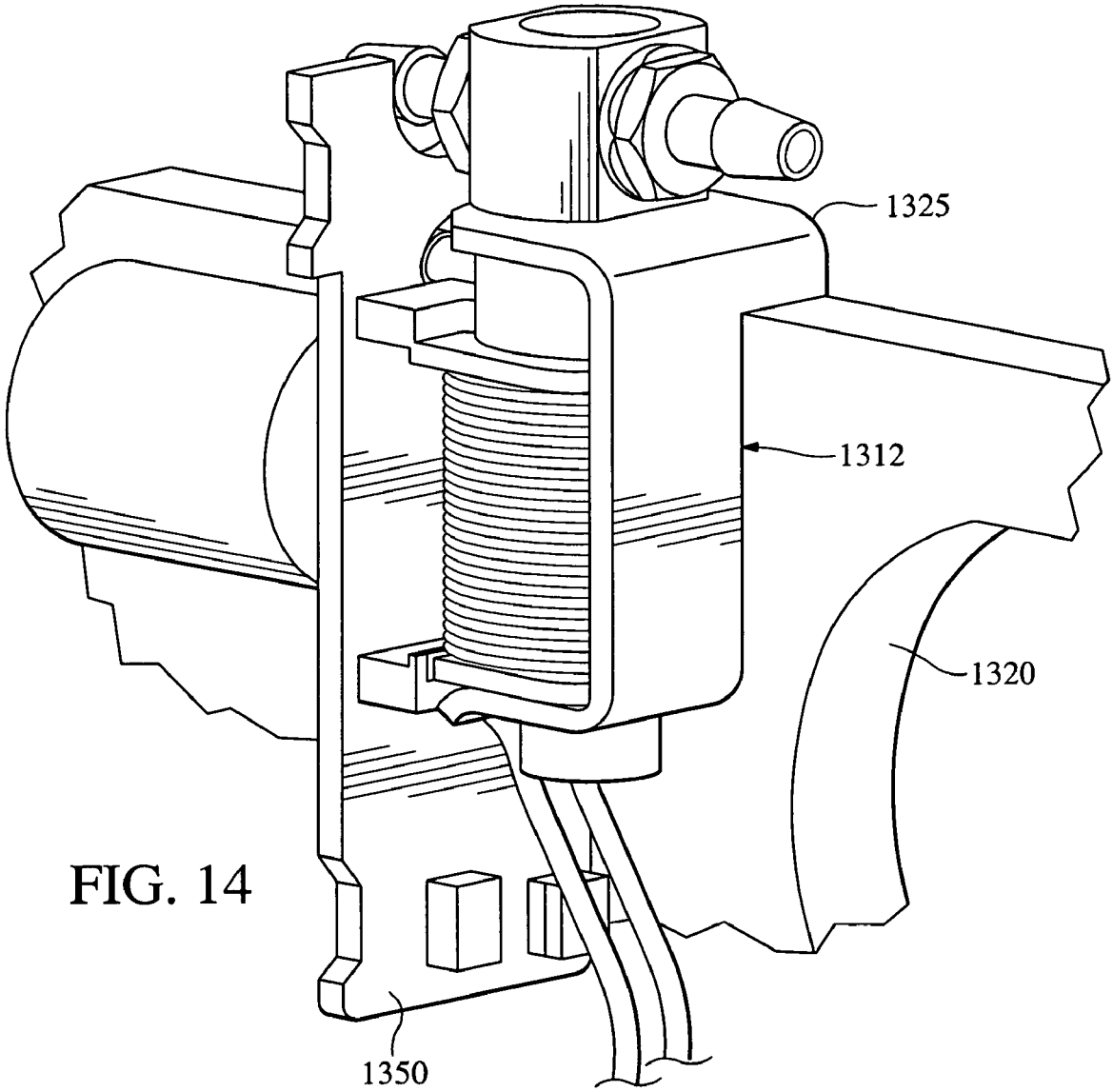
FIG. 14 is a somewhat schematic cross-sectional perspective view of a paintball gun having a grip-mounted circuit board with a solenoid valve arranged thereon.
Figure 15:
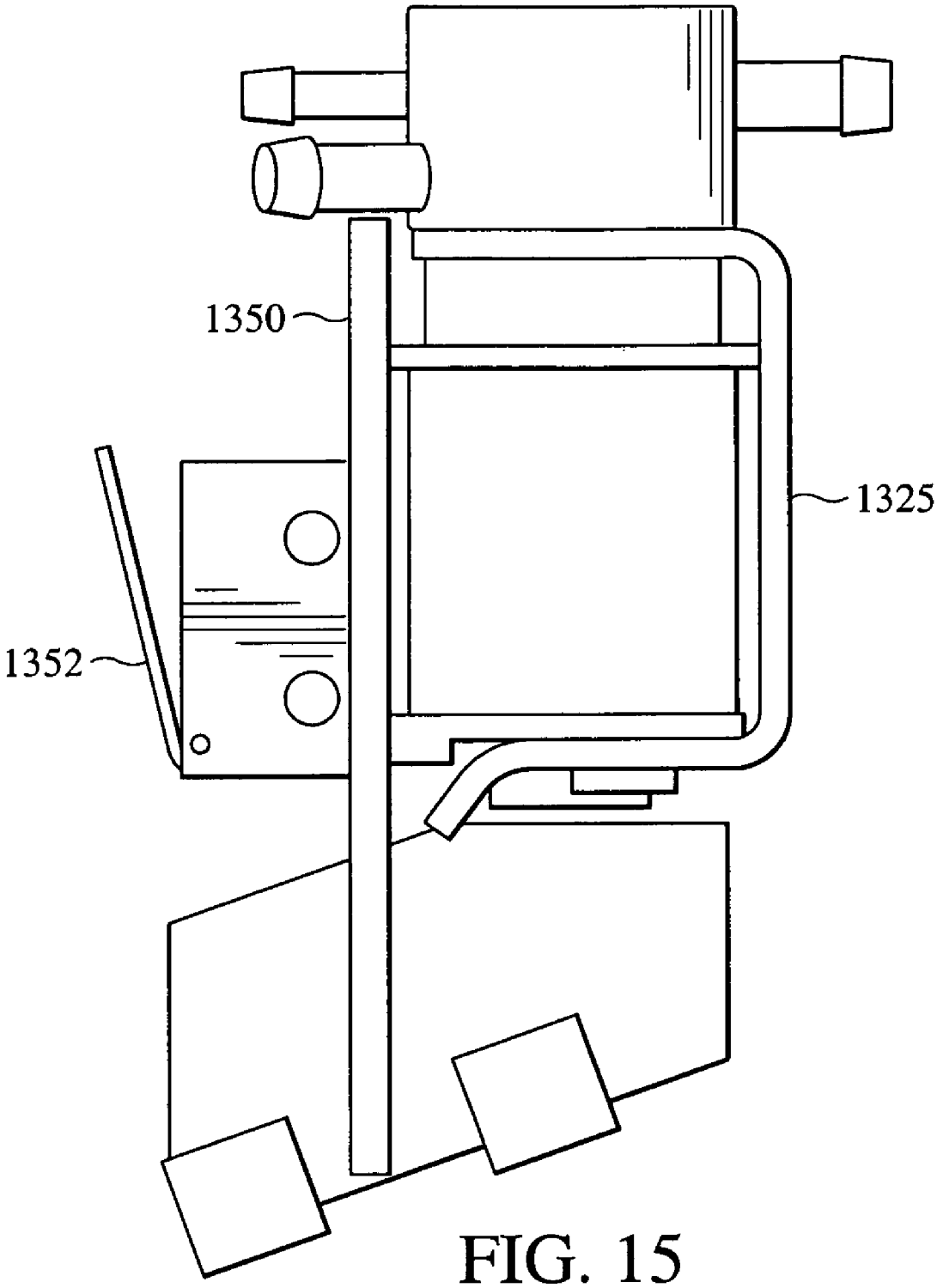
FIG. 15 is a somewhat schematic side view of a circuit board for a paintball gun having a solenoid valve and trigger-actuated microswitch arranged thereon in accordance with yet another aspect of the present invention.

FIGS. 11-12 illustrate another aspect of the present invention. Referring to FIGS. 11-12, according to a further aspect of this invention, an interchangeable shell 1100 can form the outer portion of the paintball gun body surrounding the pneumatic components 1115. The interchangeable shell 1100 can, for instance, be a plastic, metal, or composite material, but is preferably ABS plastic. A number of interchangeable shells can be provided of different shapes, colors, and body styles to permit a user to customize their gun to a desired appearance. The shell 1100 can be mounted to the grip frame, for instance, through one or more screws or other mounting device. The pneumatic components 1115 can be configured to slide into the external shell 1100 through a forward opening 1100*a* thereof.

FIGS. 13A-15 illustrate yet another aspect of the present invention. Referring to FIGS. 13A-15, according to a still further aspect of this invention, an improved apparatus and method for grip mounting a circuit board 1350 can be provided. According to this method, one or more slots 1300 are preferably arranged in the grip frame to receive the circuit board. Most preferably, one slot 1300 is arranged on each side of an opening 1310 on the inside of the grip frame 1320 to receive opposing sides of the circuit board 1350. The depth of the slots 1300 is preferably selected to arrange the circuit board 1350 in the appropriate location when the circuit board 1350 is fully inserted into the slots 1300. The circuit board 1350 and slot 1300 may further have a mating step-like configuration. In this embodiment, no tools or mounting screws are required to secure the circuit board 1350 in the paintball gun, thereby reducing the cost of parts and the cost of manufacturing. Manufacturing consistency is also improved.

A solenoid valve 1325 is preferably mounted on the circuit board 1350 and arranged in the grip 1320 of the paintball gun. A slot 1312 in the grip is preferably sized to securely receive both the circuit board 1350 and the solenoid valve 1325. The circuit board 1350 can further include a trigger-actuated microswitch 1352 arranged on the circuit board 1350, preferably on an opposite side of the circuit board 1350 from the solenoid valve 1325.

Figure 16:
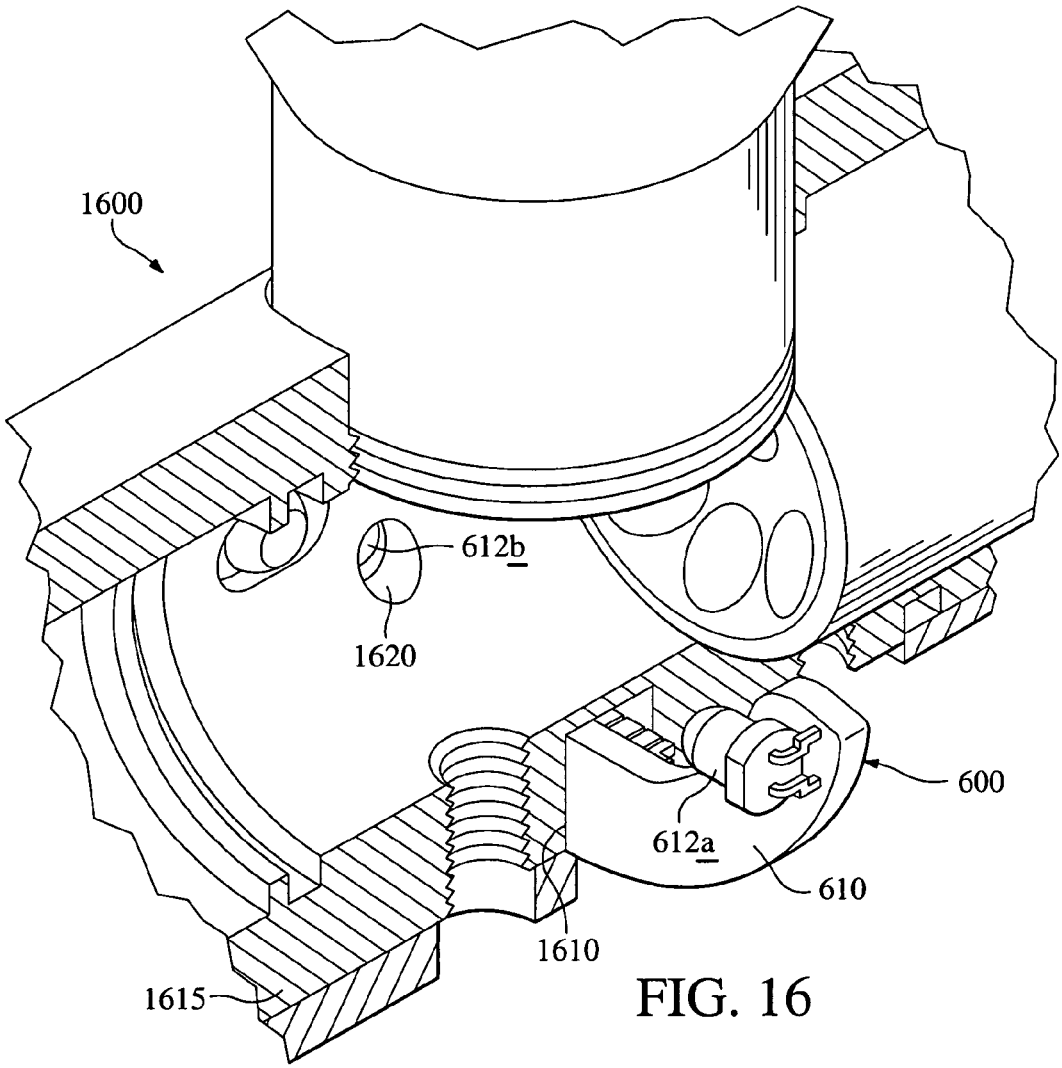
FIG. 16 is a somewhat schematic cross-sectional perspective view of a paintball gun having the paintball detection system of FIGS. 6-9, illustrating a method of mounting the paintball detection system according to another aspect of the present invention.

FIG. 16 is a cross-sectional perspective view of a section of a paintball gun 1600 illustrating a method of mounting a paintball detection system 600 according to another aspect of the present invention. A method of mounting a paintball detection system 600 is provided. According to this method, a mounting slot 1610 is preferably arranged in a bottom portion of a pneumatic housing 1615 near a breech area of a paintball gun 1600. Holes or slots 1610 are preferably arranged through one or more sidewalls of the pneumatic housing 1615 at the breech area. A paintball detection system circuit board 610 is preferably mounted within the slot 1610 such that a sensor 612*a* disposed on the circuit board 610 can communicate with an interior of the breech area or with a sensor 612*b* arranged on an opposite side of the pneumatic housing 1615. The circuit board 610 is preferably shaped to fit within the mounting slot 1610. If a break-beam sensor system is used, holes 1620 are preferably arranged in opposing sides of the pneumatic housing 1615 in proximity to the location of the break-beam sensors once installed in the pneumatic housing 1615.

Having described and illustrated various principles of the present invention through descriptions of exemplary preferred embodiments thereof, it will be readily apparent to those skilled in the art that these embodiments can be modified in arrangement and detail without departing from the inventive principles made apparent herein. The claims should therefore be interpreted to cover all such variations and modifications.

What is claimed is:

1. A bolt for a pneumatic launching device configured to launch a projectile using a pneumatic force, said launching device comprising a longitudinal chamber arranged therein; a pneumatic housing arranged within the longitudinal chamber; a compressed gas storage chamber arranged in the longitudinal chamber and configured to store a quantity of compressed gas for use in a firing operation of the launching device; and an O-ring configured to retain the quantity of compressed gas within the compressed gas storage chamber until the firing operation; said piston rod assembly comprising:

a piston rod configured to be disposed longitudinally through at least a portion of the longitudinal chamber of the launching device;

a piston surface arranged on the piston rod within the pneumatic housing and configured to move the piston rod longitudinally within the longitudinal chamber in response to a force applied by the compressed gas;

a plurality of firing grooves, each firing groove forming a trench in an outer surface of the piston rod and disposed having a length arranged longitudinally along the piston rod, wherein said length is greater than a width of the firing groove, and wherein said firing grooves are configured to be arranged in a position within the longitudinal chamber of the launching device so as to enable compressed gas from the compressed gas storage chamber to enter a compressed gas releasing chamber arranged in the pneumatic housing during the firing operation of the launching device; and a plurality of ribs arranged between the plurality of firing grooves, said ribs being configured to maintain the O-ring in communication with an outer surface of the piston rod and within an O-ring retaining groove arranged at a predetermined location in the pneumatic housing.

2. A bolt according to claim 1, wherein each of the plurality of ribs is arranged between two firing grooves.

3. A bolt according to claim 1, wherein the plurality of ribs are preferably disposed at substantially evenly-spaced intervals around a circumference of the piston rod.

4. A bolt according to claim 1, wherein a top surface of each of the ribs substantially coincides with the outer surface of the piston rod near the firing grooves.

5. A bolt according to claim 1, comprising two ribs and two firing grooves.

6. A bolt according to claim 1, comprising three ribs and three firing grooves.

7. A pneumatic paintball gun, comprising: a pneumatic housing comprising a pneumatic assembly, said pneumatic assembly comprising a compressed gas storage area;

a bolt disposed longitudinally through at least a portion of the pneumatic assembly including at least a portion of the compressed gas storage area;

a plurality of channels, wherein each channel comprises a firing groove formed as an indentation in an outer surface of the bolt to communicate compressed gas from the compressed gas storage area to a compressed gas releasing area past a sealing member arranged in communication with the outer surface of the bolt; and a plurality of ribs arranged along the bolt, said ribs configured to retain the sealing member in a sealing groove while compressed gas is transmitted from the compressed gas storage area to the compressed gas releasing area.

8. A pneumatic paintball gun according to claim 7, wherein the plurality of ribs each comprise a top surface that is substantially even with an outer surface of the bolt near the channels.

9. A pneumatic paintball gun according to claim 7, wherein the sealing member is an O-ring arranged in an O-ring groove in an O-ring retaining member disposed inside the pneumatic housing between the compressed gas storage area and the compressed gas releasing area.

10. A pneumatic paintball gun according to claim 7, wherein each of the plurality of ribs is disposed between two channels.

11. A pneumatic paintball gun according to claim 10, wherein the plurality of ribs are substantially evenly disposed around a circumference of the bolt.

12. A pneumatic paintball gun according to claim 11, wherein the plurality of ribs comprises three or more ribs.

13. A pneumatic paintball gun according to claim 7, wherein each channel is formed between two ribs, and wherein a top surface of each rib is substantially even with the outer surface of the bolt.

14. A bolt assembly for a paintball gun configured to launch a painthall using a pneumatic force, said paintball gun comprising a longitudinal chamber arranged therein: a compressed gas storage chamber arranged in the longitudinal chamber and configured to store a quantity of compressed gas for use in a firing operation of the launching device: and an O-ring configured to retain the quantity of compressed gas within the compressed gas storage chamber until the firing operation: said piston rod assembly comprising:

a piston rod disposed substantially longitudinally in the longitudinal chamber through at least a portion of the paintball gun;

a piston surface arranged on the piston rod and configured to move the piston rod within the longitudinal chamber in response to a force created by the quantity of compressed gas;

a plurality of firing grooves, each firing groove formed by providing an indentation in an outer surface of the piston rod to communicate compressed gas from the compressed gas storage chamber through the grooves during a firing operation of the paintball gun; and a plurality of ribs arranged between the plurality of grooves to maintain the O-ring in communication with an outermost surface of the piston rod and within an O-ring retaining groove arranged at a predetermined location in the painthall gun.

15. A bolt according to claim 14, wherein each of the plurality of ribs has an outermost surface substantially even with the outer surface of the piston rod on either end of an adjacent groove.

16. A bolt according to claim 15, wherein each of the plurality of grooves has a depth sufficient to permit compressed gas to escape through the groove when the O-ring is in communication with the adjacent ribs.

17. A pneumatic paintball gun, comprising:

a pneumatic housing comprising a pneumatic assembly, said pneumatic assembly comprising a compressed gas storage area;

a bolt disposed through at least a portion of the pneumatic assembly including the compressed gas storage area;

a plurality of grooves in constant communication with the compressed gas storage area and formed in an outer surface of the bolt, to communicate compressed gas from the compressed gas storage area to a compressed gas releasing area only when the bolt is in a forward position;

a sealing member arranged in communication with the outer surface of the bolt to selectively prevent the flow of compressed gas into the grooves; and a plurality of ribs arranged along the bolt, said ribs configured to retain the sealing member in a sealing groove while compressed gas is transmitted through the grooves from the compressed gas storage area to the compressed gas releasing area.

18. A pneumatic paintball gun according to claim 17, wherein the plurality of ribs each comprise a top surface that is substantially even with an outer surface of the piston rod at each end of the grooves.

19. A bolt for a paintball gun comprising a chamber configured to house a quantity of compressed gas, the bolt assembly comprising:

a bolt comprising two or more firing grooves, wherein each firing groove comprises an indentation formed in an outer surface of the bolt that is configured to communicate the compressed gas from the chamber to a forward end of the bolt for launching a paintball during a firing operation of the paintball gun;

a bolt port arranged through the forward end of the bolt piston rod to communicate compressed gas into contact with a paintball to launch the paintball from the paintball gun during the firing operation;

a sealing member arranged in communication with the outer surface of the wherein the sealing member is configured to prevent the compressed gas in the chamber from entering the bolt port through the firing grooves when the bolt is in a first position and to permit compressed gas to be released through the firing grooves when the bolt is in a second position, and wherein the sealing member is retained in a sealing member groove; and one or more ribs arranged between the firing grooves to cause the sealing member to be retained in the sealing member groove when the bolt is in the second position.

20. A bolt according to claim 19, wherein the one or more firing groove indentations each have a depth sufficient to permit the passage of compressed gas through the firing groove and around the sealing member when the bolt piston rod is in the second position.

21. A bolt according to claim 20, wherein the depths of each of the indentations are approximately the same.

22. A bolt according to claim 19, wherein the firing grooves each have a length that is longer than a width of the sealing member.

23. A bolt according to claim 22, wherein the ribs are substantially evenly spaced apart from each other around the circumference of the bolt piston rod.

24. A bolt for a paintball gun, comprising:

a bolt comprising one or more grooves formed as trenches along an outer surface of the bolt piston to communicate compressed gas through the grooves;

a bolt port arranged through a forward end of the bolt to communicate compressed aas from the firing grooves through the bolt port to launch a paintball from the paintball gun during a firing operation of the paintball gun;

a sealing member arranged in communication with the outer surface of the bolt to prevent compressed gas from entering the grooves when the bolt is in a first position and to permit compressed gas to be released through the grooves when the bolt is in a second position, and wherein the sealing member is retained in a separate sealing ring groove; and one or more ribs arranged along the bolt between the grooves to retain the sealing ring in the sealing ring groove when the bolt is in the second position.

25. A bolt according to claim 24, wherein each of the grooves comprises a length greater than a width thereof.

26. A bolt according to claim 24, wherein each trench has a bottom surface arranged closer to a center axis of the bolt piston than the outer surface of the bolt piston rod on either end of the recess.

27. A bolt according to claim 24, wherein each of the trenches has a depth sufficient to permit the passage of compressed gas through the groove and around the sealing member when the bolt piston rod is in a firing position.

28. A bolt according to claim 27, wherein the depths of each of the trenches are approximately the same.

29. A bolt according to claim 24, wherein the firing grooves are in constant communication with a compressed gas storage area.

* * * * *